US005207194A

United States Patent [19]

Clerici

[11] Patent Number: 5,207,194

[45] Date of Patent: May 4, 1993

[54] SYSTEM FOR STARTING AN INTERNAL COMBUSTION ENGINE FOR MOTOR VEHICLES

[75] Inventor: Guido Clerici, Milano, Italy

[73] Assignee: Industrie Magneti Marelli SPA, Milano, Italy

[21] Appl. No.: 781,872

[22] Filed: Oct. 24, 1991

[30] Foreign Application Priority Data

Oct. 25, 1990 [IT] Italy ..... 67822 A/90

[51] Int. Cl.[5] ..... F02N 11/00

[52] U.S. Cl. ..... 123/179.1; 290/38 R; 290/48

[58] Field of Search ..... 123/179.1, 179.28, 179.25; 290/36 R, 38 R, 50, 48

[56] References Cited

U.S. PATENT DOCUMENTS 5,041,776 8/1991 Shirata et al. ..... 290/38 R
5,146,095 9/1992 Tsuchiya et al. ..... 290/38 R
5,155,373 10/1992 Tsuchiya et al. ..... 123/179.1

FOREIGN PATENT DOCUMENTS 0390398 10/1990 European Pat. Off. ..... 290/48
0390399 10/1990 European Pat. Off. ..... 290/48
2-271072 11/1990 Japan ..... 290/50
1193287 11/1985 U.S.S.R. ..... 290/38 R

*Primary Examiner*—Andrew M. Dolinar
*Attorney, Agent, or Firm*—Sughrue, Mion, Zinn, Macpeak & Seas

[57] ABSTRACT

The system includes a storage battery, and an electric starter motor operable to rotate the internal combustion engine. A capacitor of high-capacitance, arranged immediately adjacent the electric motor, is adapted to store enough electrical energy to supply the electric motor during the starting of the internal combustion engine. A connection control system in a first condition connects the capacitor to the battery to enable the capacitor to be recharged and, in a second condition, connects the capacitor to the electric motor to enable electrical energy to be transferred thereto.

4 Claims, 2 Drawing Sheets

SYSTEM FOR STARTING AN INTERNAL COMBUSTION ENGINE FOR MOTOR VEHICLES

BACKGROUND OF THE INVENTION

The present invention relates to a system for starting an internal combustion engine for motor vehicles.

More specifically, the invention concerns a starting system including:

a storage battery, and an electric starter motor which can be operated to rotate the internal combustion engine.

In systems of this type currently in use, in order to operate the electric starter motor, it must be supplied with an electrical current of the order of hundreds of amps for periods of time which may vary, for example, from one to thirty seconds. In conventional starter systems, this current is typically supplied by a storage battery, generally a lead-acid battery, which is also intended to store and supply the electrical energy needed to operate the electrical equipment in the vehicle. The batteries normally used are quite bulky and heavy. Moreover, connecting wires which have suitable cross-sections, and are thus heavy and expensive, are required between such a battery and an electric starter motor.

The performance of conventional storage batteries is very sensitive to their operating temperatures.

SUMMARY OF THE INVENTION

The object of the present invention is to provide a system for starting an internal combustion engine whose electrical performance is generally improved and which avoids the problems of conventional systems described above.

According to the invention, this object is achieved by a starting system of the type specified above, the main characteristic of which lies in the fact that it includes:

capacitive means of high static capacitance arranged immediately adjacent the electric starter motor and adapted to store enough electrical energy to supply the electric motor during the starting of the internal combustion engine, and connection means adapted, in a first condition, to connect the capacitive means to the battery to enable the capacitive means to be recharged and, in a second condition, to connect the capacitive means to the electric motor to enable electrical energy to be transferred from the capacitive means to the electric starter motor.

Electrical capacitors with much higher capacitances than conventional capacitors have recently become available. These capacitors, which are known as molecular or double-layer capacitors or even as supercapacitors, can store extremely large quantities of electrical energy or charge and can be charged and discharged in very short periods of time, that is, with very much higher specific powers than were possible with conventional electrochemical accumulators.

The capacitances of such supercapacitors remain almost unchanged even after a very large number of charge and discharge cycles (more than $10^4$) and are largely unaffected by their operating temperatures which may vary within wide limits, for example, between $-40°$ C. and $+70°$ C.

The use of such capacitors, for example, of the type with activated carbon and an aqueous electrolyte which are ecologically acceptable materials, disposed, according to the invention, in the immediate vicinity of the electric starter motor, enables connecting wires with small cross-sections to be used for the connection to the battery. The weight and cost of the system are thus reduced and its performance is improved since the losses in the connecting cables are reduced.

In the system according to the invention, the battery of the motor vehicle may be smaller than was necessary in conventional systems, since it need only be suitable for supplying slow-discharge user equipment. As the battery is subject to less stress than in conventional systems, a working life equal to that of the entire motor vehicle can be achieved.

In a system according to the invention, the battery may, for example, be a lead battery of the gas-recombination type for location remote from the internal combustion engine. In fact, this type of battery is quite sensitive to the high temperatures which may be developed in the engine compartment. They are more convenient, however, since they have fewer electrodes, their internal and external rheophores weigh less and they can withstand being run down for longer periods.

BRIEF DESCRIPTION OF THE DRAWINGS

Further characteristics and advantages of the invention will become clear from the detailed description which follows with reference to the appended drawings, provided purely by way of non-limiting example, in which.

DETAILED DESCRIPTION OF THE INVENTION

Figure 1:
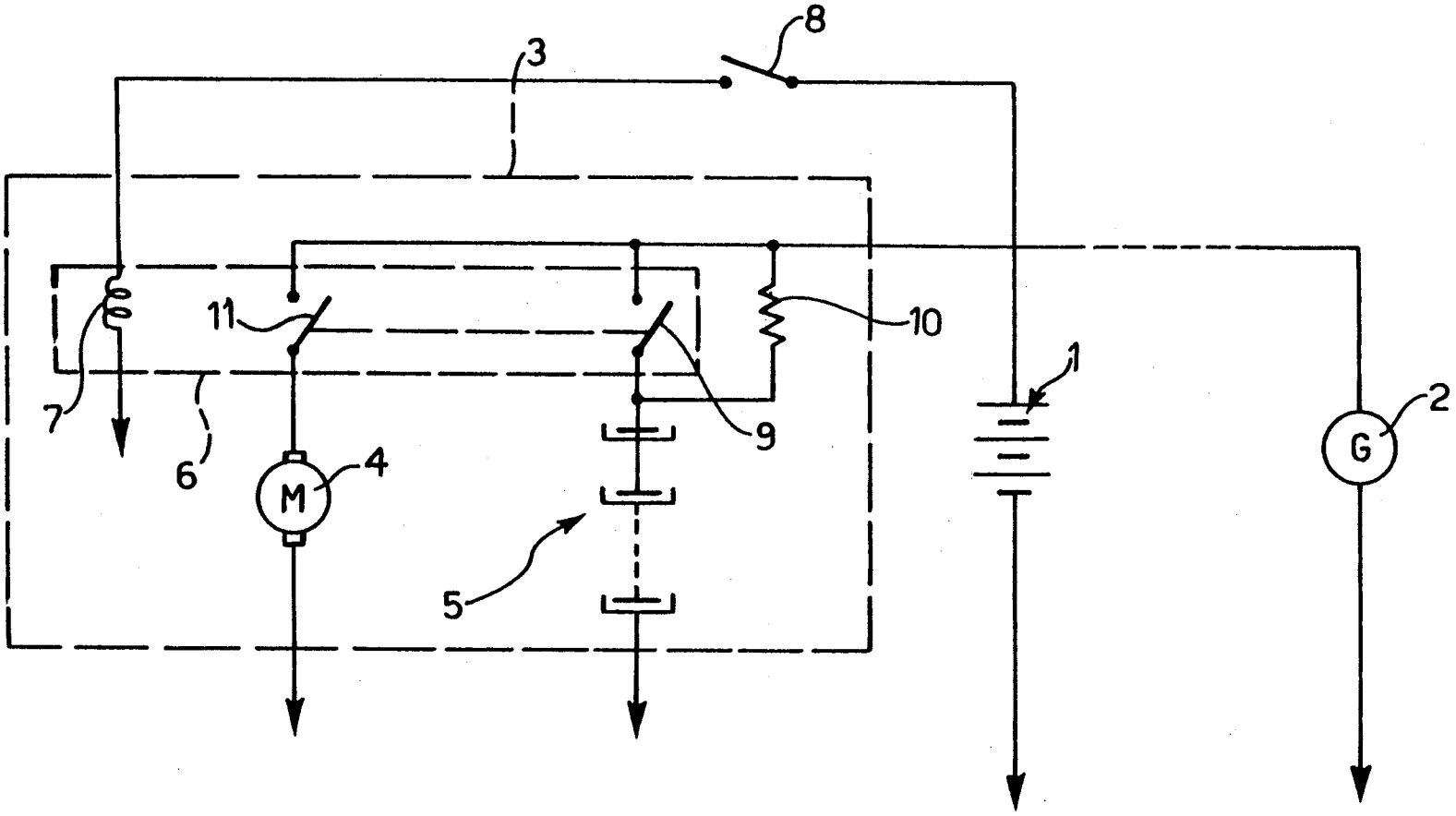
FIG. 1 is a general electrical diagram of a starting system according to the invention.

With reference to FIG. 1, a starting system according to the invention includes a storage battery 1 which, as stated above, may be constituted, for example, by a gas-recombination-type lead battery. An electrical generator 2 driven by the internal combustion engine is associated with the battery 1 in conventional manner for recharging it.

Figure 2:
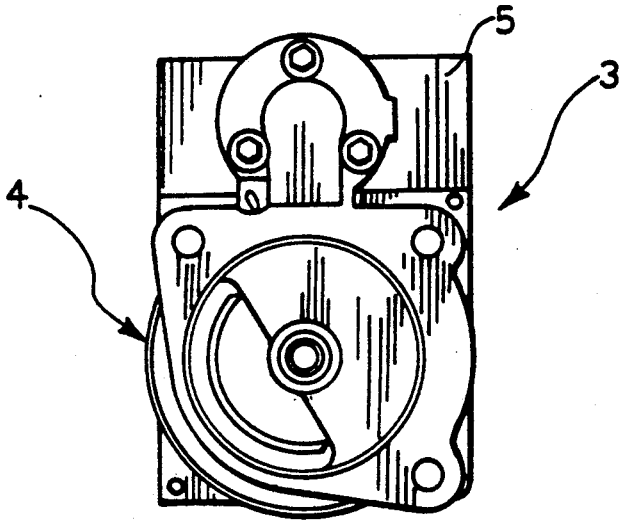
FIGS. 2 and 3 are a front view and a side view of an electric starter motor with an attached battery of capacitors for a system according to the invention.
Figure 3:
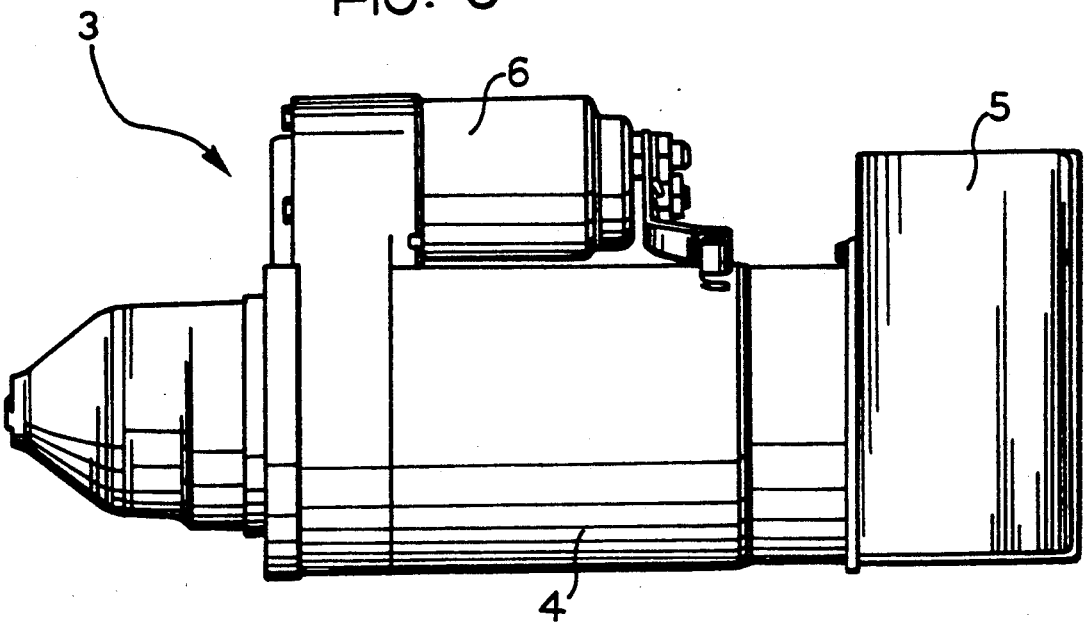

A starter unit, generally indicated 3, includes a direct-current electric motor 4, a battery of supercapacitors 5 and an electromagnetically-controlled double switch 6. A structural embodiment of the starter unit 3 is shown in FIGS. 2 and 3.

In the embodiment shown by way of example, the electromagnetically-controlled double switch 6 includes an excitation solenoid 7 connected at one end to earth and connectible at its other end to the battery 1 by means of a manually-operated switch 8 which can be operated, for example, by the ignition and starting switch of the motor vehicle. The solenoid 7 controls the positions of two switches 9 and 11 which are arranged as shown in FIG. 1 and, in their closed conditions, can connect the battery of capacitors 5 to the electric starter motor 4. In its closed condition, the switch 9 short-circuits a resistor 10 between the battery of capacitors 5 and the storage battery 1.

When the switches 9 and 11 are open, the electric motor 4 is disconnected both from the battery of capacitors 5 and from the storage battery 1, whilst the battery of capacitors 5 is connected to the storage battery 1 through the resistor 10. In this condition, the capacitors can be charged as appropriate.

In order to start the internal combustion engine, the switch 8 is closed, energising the control solenoid 7 which closes the switches 9 and 11. The battery of capacitors 5 is thus discharged rapidly into the electric starter motor 4 so as to activate it.

Electrical wires with small diameters suffice for connecting the starter unit 3 to the storage battery 1 since they are intended to carry currents of quite low intensities.

The starter capacitors 5 may conveniently be located in a container connected to the housing of the electric starter motor 4 or the housing of the electric motor 4 may be formed so that it can also house the capacitors.

For example, in order to provide a starting system which can supply 200 A at a voltage of about 9V for about 10 seconds, it is necessary to be able to supply about 18 kjoules of energy. Now, the energy which can be stored in a capacitor is 0.5 $CV^2$, where C is the capacitance and V is the voltage across the capacitor. Since the voltage V across the capacitor decreases exponentially as a function of the discharge period, it can be calculated that a capacitance of about 600 F. is required in order to supply 18 kjoules of energy. This capacitance can be achieved with capacitors of the type having activated carbon and an aqueous electrolyte with normal voltages of about 0.9 V. For example, a series of thirteen such capacitors, each of 7800 F., is needed. It is possible to form such a battery of capacitors occupying a space of about 0.3 $dm^3$ and weighing 0.6 kg.

The storage battery 1 of the starting system of the invention is intended to constitute the energy reserve for the slow-discharge users of electricity and to keep the battery of supercapacitors charged. It can thus be constituted by a series of six lead accumulators of about 20 Ah which can be made so as to weigh about 6 kg, and hence about 50% of the weight of a battery currently used for starting a motor car. If the battery is of the gas-recombination type with an immobilised electrolyte, the volume of the battery can also be about half that of a normal battery.

A system thus formed according to the invention saves copper (connecting cables) to the extent of about 1 kg and more if the battery of the motor vehicle is located outside the engine compartment.

The overall cost of the system may be less in view of the lower cost of the storage battery and of the connecting cables.

Naturally, the principle of the invention remaining the same, the forms of embodiment and details of construction may be varied widely with respect to those described and illustrated purely by way of non-limiting example, without thereby departing from the scope of the present invention.

What is claimed is:

1. A system for starting an internal combustion engine for motor vehicles, including:

a storage battery, an electric starter motor operable to rotate the internal combustion engine, capacitive means of high-capacitance arranged immediately adjacent the electric motor and adapted to store enough electrical energy to supply the electric motor during the starting of the internal combustion engine, and connection means adapted, in a first condition, to connect the capacitive means to the battery to enable the capacitive means to be recharged and, in a second condition, to connect the capacitive means to the electric motor to enable electrical energy to be transferred from the capacitive means to the electric motor;

wherein housing means for said capacitive means and said starter motor are connected to define a unitary assembly.

2. A starting system according to claim 1, wherein the capacitive means comprise a plurality of molecular or double-layer capacitors.

3. A starting system according to claim 2, wherein the capacitors are of the type which have activated carbon and an aqueous electrolyte.

4. A starting system according to claim 1, wherein the battery is a lead battery of the gas-recombination type.

* * * * *